US009072978B2

(12) United States Patent
Thayer

(10) Patent No.: US 9,072,978 B2
(45) Date of Patent: Jul. 7, 2015

(54) WATERSLIDE ASSEMBLY AND SYSTEM

(71) Applicant: iZoom, LLC, Grand Rapids, MI (US)

(72) Inventor: Matthew Thayer, Grand Rapids, MI (US)

(73) Assignee: iZoom, LLC, Grand Rapids, MI (US)

( * ) Notice: Subject to any disclaimer, the term of this patent is extended or adjusted under 35 U.S.C. 154(b) by 176 days.

(21) Appl. No.: 13/834,511

(22) Filed: Mar. 15, 2013

(65) Prior Publication Data

US 2013/0203513 A1 Aug. 8, 2013

Related U.S. Application Data

(63) Continuation of application No. 12/845,980, filed on Jul. 29, 2010, now Pat. No. 8,419,557.

(60) Provisional application No. 61/230,018, filed on Jul. 30, 2009.

(51) Int. Cl.

| | |
|---|---|
| ***A63G 21/18*** | (2006.01) |
| ***A63G 31/00*** | (2006.01) |
| *E02D 5/80* | (2006.01) |

(52) U.S. Cl.

CPC ..... *A63G 21/18* (2013.01); *A63G 31/007* (2013.01); *E02D 5/80* (2013.01)

(58) Field of Classification Search

CPC ..... A63G 21/00; A63G 21/02; A63G 21/08; A63G 31/00; A63G 31/007; A63B 2009/008; E04H 15/00; E04H 15/62

USPC ..... 472/116, 117, 128; 52/3, 4, 5, 156; 248/500, 505

See application file for complete search history.

(56) References Cited

U.S. PATENT DOCUMENTS

| | | | | |
|---|---|---|---|---|
| 4,682,447 | A | | 7/1987 | Osborn |
| 5,154,671 | A | * | 10/1992 | Smollar et al. ..... 472/117 |
| 5,349,834 | A | | 9/1994 | Davidge |
| 5,401,214 | A | * | 3/1995 | Smollar et al. ..... 472/117 |
| 5,551,922 | A | | 9/1996 | Katz et al. |
| 5,662,305 | A | | 9/1997 | Shimamura et al. |
| 6,692,257 | B1 | | 2/2004 | Branum et al. |

OTHER PUBLICATIONS

U.S. Office Action regarding U.S. Appl. No. 12/845,980, mailed Aug. 1, 2012.

U.S. Notice of Allowance regarding U.S. Appl. No. 12/845,980, mailed Jan. 7, 2013.

* cited by examiner

*Primary Examiner* — Kien Nguyen

(74) *Attorney, Agent, or Firm* — Harness, Dickey & Pierce, P.L.C.; Michael Malinzak

(57) ABSTRACT

The present disclosure provides an apparatus comprising a flexible polymeric sheet having first and second sides and an anchoring device including a tab element, a pressure-sensitive adhesive element, and a stake element.

53 Claims, 9 Drawing Sheets

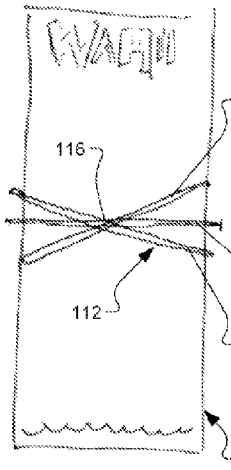
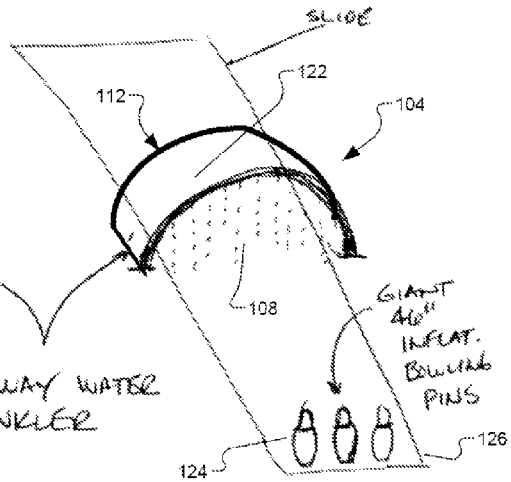
ARCHWAY WATER SPRINKLER
FIG. 9
FIG. 11
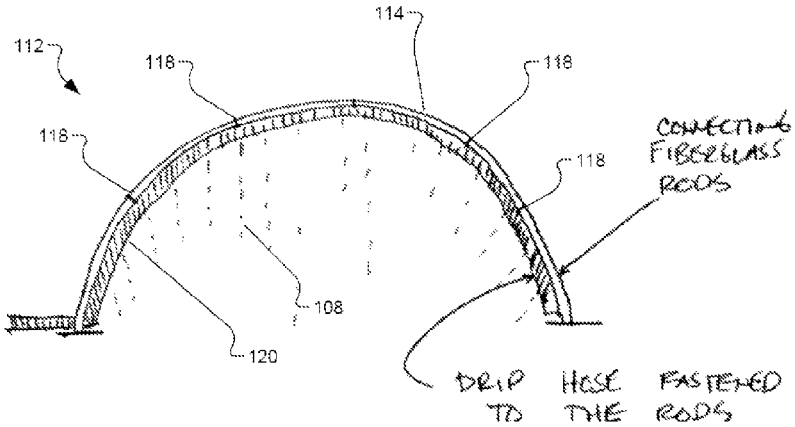
FIG. 10

WATERSLIDE ASSEMBLY AND SYSTEM

CROSS-REFERENCE TO RELATED APPLICATIONS

This application is a continuation of U.S. application Ser. No. 12/845,980, filed Jul. 29, 2010, which claims the benefit of U.S. Provisional Application No. 61/230,018, filed on Jul. 30, 2009. The entire disclosure of the above applications is incorporated herein by reference.

FIELD

The present disclosure relates to a flexible polymeric sheet, a device for anchoring the polymeric sheet including a tab element, a pressure-sensitive adhesive element, and a stake element.

BACKGROUND

During the hot summer days, it is common to see people of all ages enjoying water-specific recreational activities. For example, children can often be found spending countless hours sliding on a waterslide. Waterslides designed for the home user are typically made of a tough plastic material, which is attached to a garden hose to provide a supply of water. The water on the waterslide reduces friction so that sliders travel down the waterslide at a high rate of speed.

While the lubricity of the waterslide allows for a pleasant slip-sliding experience, it may also cause the waterslide to become bunched. This bunching can cause a slider to become entangled and may also lead to damage to the waterslide.

SUMMARY

This section provides a general summary of the disclosure, and is not a comprehensive disclosure of its full scope or all of its features.

In one form, an apparatus includes a flexible polymeric sheet having first and second sides, as well as an anchoring device including a tab element, a pressure-sensitive adhesive element, and a stake element.

A height of the tab element may be less than either a length of a first side of the tab element or a length of a second side of the tab element. The tab element may be semi-rigid poly material and having a thickness of thirty thousandths (0.030) of an inch. The tab element may include at least one aperture to receive the stake element.

The stake element may include multiple prongs and the tab element may include multiple apertures to receive the stake element. Each of the prongs may have a length that is approximately equal to a distance between the tab apertures.

The adhesive element may include a bond strength allowing disengagement from the tab element in response to a force applied to the polymeric sheet relative to the tab element sufficient to plastically deform the polymeric sheet. A sheer strength of the bond strength may be less than a tensile yield strength of the polymeric sheet.

The tab element and the pressure-sensitive adhesive element may be joined and affixed to first and second sides of the flexible polymeric sheet. The tab element may include first and second arms cooperating to form a clamp.

The flexible polymeric sheet is formed from a material selected from a group consisting of polyethylene, polyvinylchloride, and polypropylene. The flexible polymeric sheet may formed from a material having a thickness between five thousandths (0.005) and ten thousandths (0.010) of an inch.

The apparatus may also include an irrigation device adapted to distribute water onto a surface of the flexible polymeric sheet. The irrigation device may include an archway water sprinkler. The irrigation device provides a water curtain. The apparatus may also include a resiliently compliant obstacle adapted to be positioned on the flexible polymeric sheet.

In other forms, the present disclosure provides a waterslide that may include a flexible slide portion and an anchor portion. The anchor portion may secure the slide portion to a surface and may include a tab element, a stake element, and an adhesive element.

In another form, the present disclosure provides an apparatus that may include a polymeric sheet and an anchoring device. The polymeric sheet may include first and second sides. The anchoring device may include a first arm, a second arm, and a retention device. The first and second arms may be integrally formed with each other and movable relative to each other between an open position and a closed position. The first and second arms may engage the first and second sides of the polymeric sheet, respectively, in the closed position. The retention device may urge the first and second arms toward the closed position.

In yet another form, the present disclosure provides a method that may include providing a flexible slide portion and positioning the slide portion on a ground surface. An anchor portion may be provided and may include a tab element and a stake element. The tab element may include a first surface, a second surface and an adhesive element. A first portion of the adhesive element may be positioned on the first surface. A second portion of the adhesive element may be positioned on a surface of the sheet. At least a portion of the stake element may be inserted through the tab element. The tab element may be fixed relative to the ground surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 9 is an overhead view of another embodiment of the waterslide of FIG. 8 depicting an archway water sprinkler system according to the principles of the present disclosure;

FIG. 10 is a perspective view of the archway water sprinkler system of FIG. 9;

FIG. 11 is a perspective view of another embodiment of the archway water sprinkler system;

Corresponding reference numerals indicate corresponding parts throughout the several views of the drawings.

DETAILED DESCRIPTION

Figure 1:
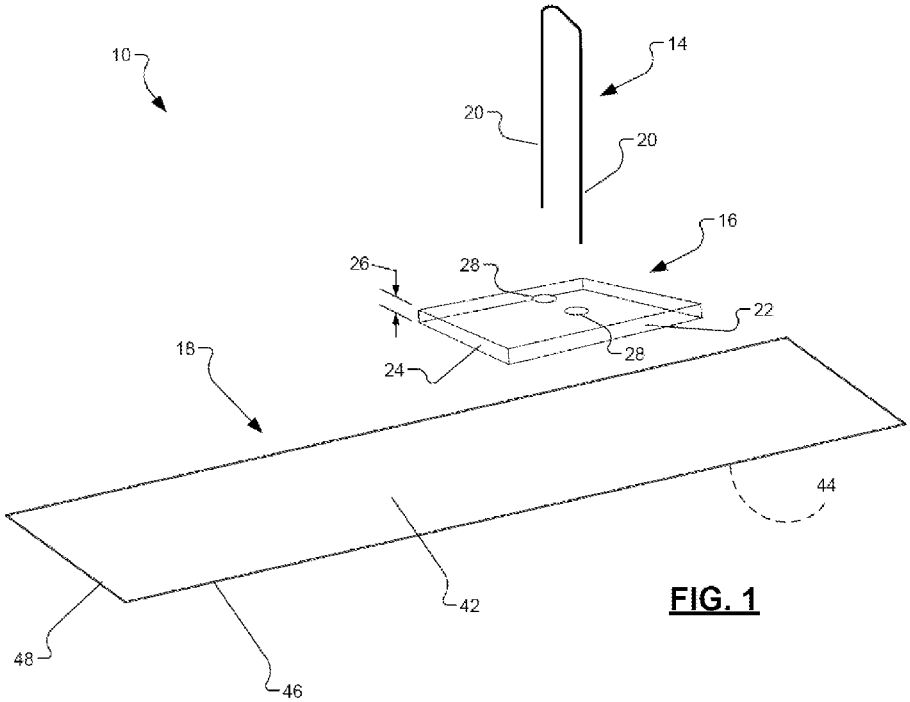
FIG. 1 is a perspective view of a waterslide anchoring device according to the principles of the present disclosure.

The following description is merely exemplary in nature and is not intended to limit the present teachings, application, or uses. It should be understood that throughout the drawings, corresponding reference numerals indicate like or corresponding parts and features. Although the following description relates generally to a device for use in anchoring a waterslide, it will be understood that the device as described and claimed herein can be used in any manner where it is desired to securely retain an item to the ground. Therefore, it will be understood that the following discussions are not intended to limit the scope of the present teachings and claims herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With general reference to the various figures, a waterslide anchoring device in accordance with the present teachings is illustrated and generally identified at reference character 10. The waterslide anchoring device 10 may be used to anchor a waterslide 12 (FIG. 7) to a surface, such as the ground or floor (not shown). The waterslide 12 may be made of polyethylene, polyvinylchloride, polypropylene, or any other polymeric material that becomes suitably slippery when water is applied to its surface. For example, the waterslide 12 may be made of a flexible material such as polyethylene shrinkwrap. The waterslide 12 may be between about five thousandths to ten thousandths (0.005-0.010) of an inch thick, for example, or any other thickness suitable to withstand forces associated with a mass sliding over its surface. In one embodiment, the waterslide 12 thickness may be about eight thousandths (0.008) of an inch.

Referring now to FIG. 1, the waterslide anchoring device 10 may include at least one stake element 14, a tab element 16, and at least one adhesive element 18. The stake element 14 may include prongs 20 that can be pushed or driven into the surface to which the waterslide 12 is secured. The stake element 14 may be made of metal, plastic, wood, or any other material suitable for pushing or driving into a surface.

The tab element 16 may have a substantially rectangular shape, such that a first side 22 may be substantially longer than a second side 24. A height 26 of the tab element 16 may be substantially less than either the length of the first side 22 or the length of the second side 24 and may be about thirty thousandths (0.030) of an inch, for example. The tab element 16 may be made of plastic, metal, cardboard, or any other suitable semi-rigid material.

The tab element 16 may also include apertures 28. The apertures 28 may have a circular cross-section operable to receive the prongs 20 of the stake element 14 therethrough. Accordingly, the number of prongs 20 may correspond to the number of apertures 28, and the distance between the prongs 20 is substantially equal to the distance between the apertures 28.

Figure 2:
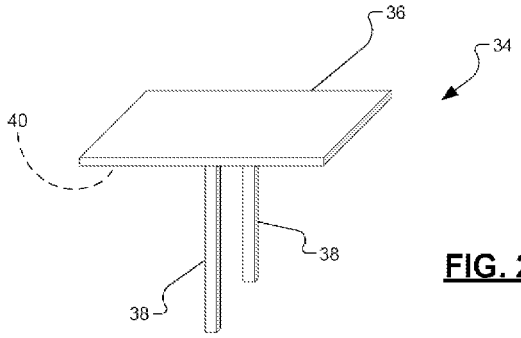
FIG. 2 is a perspective view of another embodiment of a stake element of the waterslide anchoring device of FIG. 1.

In another embodiment, the tab element 16 may be integrally formed with the stake element 14 to form a winged stake element 34 (FIG. 2). The winged stake element 34 may include a top portion 36 and lower portions 38. The top portion 36 may be substantially the same size as the tab element 16. The lower portions 38 may extend perpendicularly from a lower surface 40 of the top portion 36. The lower portions 38 may be substantially the same size as the prongs 20.

Referring again to FIG. 1, the at least one adhesive element 18 may be duct tape, gaffer's tape, or any other material that includes an adhesive upper side 42 and a non-adhesive underside 44. The adhesive element 18 may have a substantially rectangular shape, such that a first edge 46 may be substantially longer than a second edge 48. The lengths of the first and second edges 46, 48 of the adhesive element 18 may correspond to the lengths of the first and second sides 22, 24 of the tab element 16, such that the first edge 46 is substantially longer than the first side 22 and the second edge 48 is substantially equal to the second side 24. In one embodiment, the length of the first edge 46 of the adhesive element 18 may be four times greater than the length of the first side 22 of the tab element 16.

Figure 3:
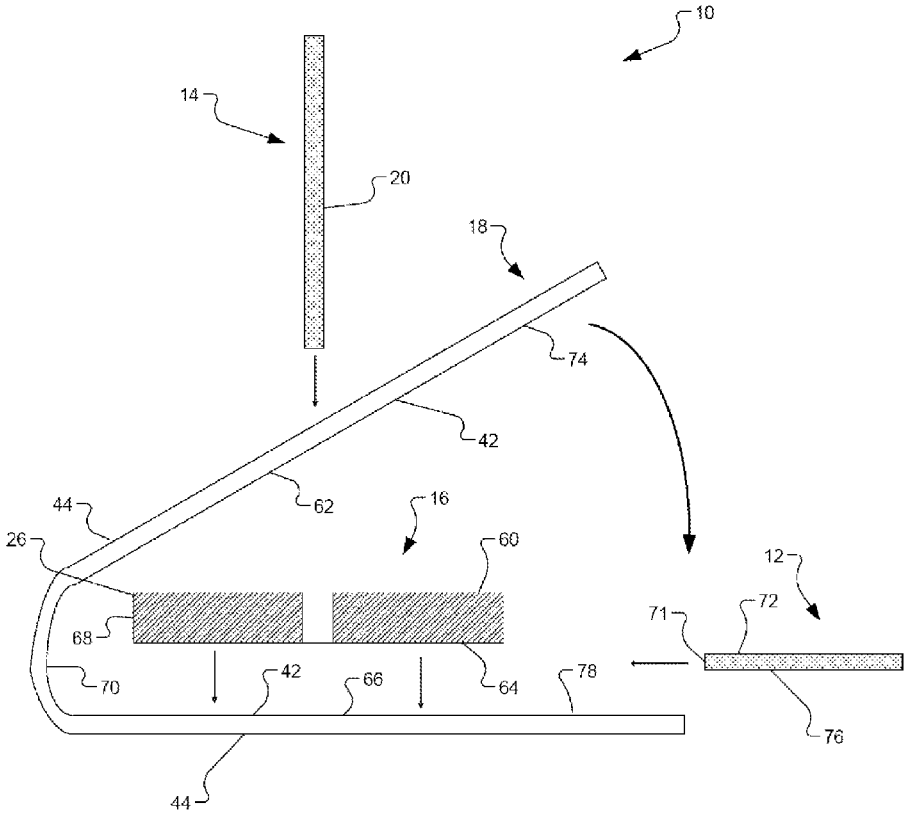
FIG. 3 is a cross-sectional view of the waterslide anchoring device of FIG. 1 prior to assembly.
Figure 4:
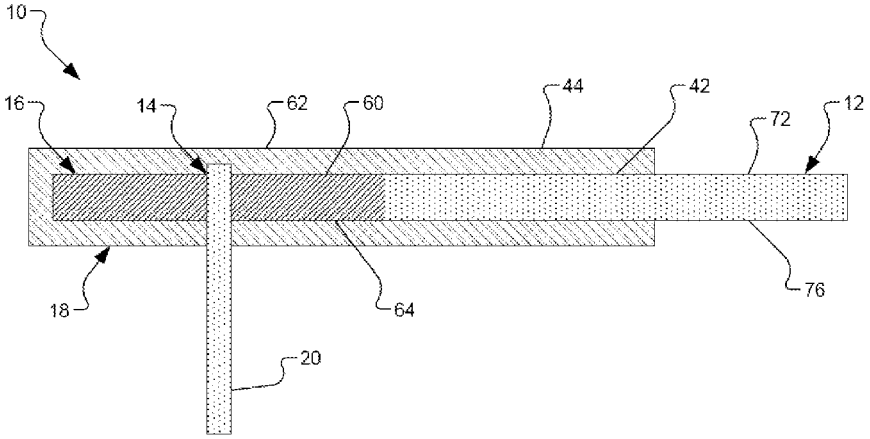
FIG. 4 is a cross-sectional view of the waterslide anchoring device of FIG. 1 in an assembled condition according to the principles of the present disclosure.

With reference to FIGS. 3 and 4, a method of anchoring the waterslide 12 to the surface may include positioning a first side 60 of the tab element 16 against a first portion 62 of the upper side 42 of the adhesive element 18 and positioning a second side 64 of the tab element 16 against a second portion 66 of the upper side 42 of the adhesive element 18. The tab element 16 may be located against the adhesive element 18 so that a mid-point 68 along the height 26 of the tab element 16 corresponds to a mid-point 70 of the adhesive element 18.

The method may further include positioning an edge 71 of the waterslide 12 substantially adjacent to the tab element 16, such that a portion of an upper surface 72 of the waterslide 12 is positioned against a third portion 74 of the upper side 42 of the adhesive element 18 and a lower surface 76 of the waterslide 12 is positioned against a fourth portion 78 of the upper side 42 of the adhesive element 18. As can be seen, the lengths of the third and fourth portions 74, 78 correspond to approximately half the difference between the length of the adhesive element 18 and the tab element 16. In this way, the adhesive element 18 may grip the waterslide 12 at both upper and lower surfaces 72, 76, respectively. Finally, the prongs 20 of the stake element 14 may slide through the adhesive element 18 and down through the apertures 28 of the tab element 16.

Figure 5:
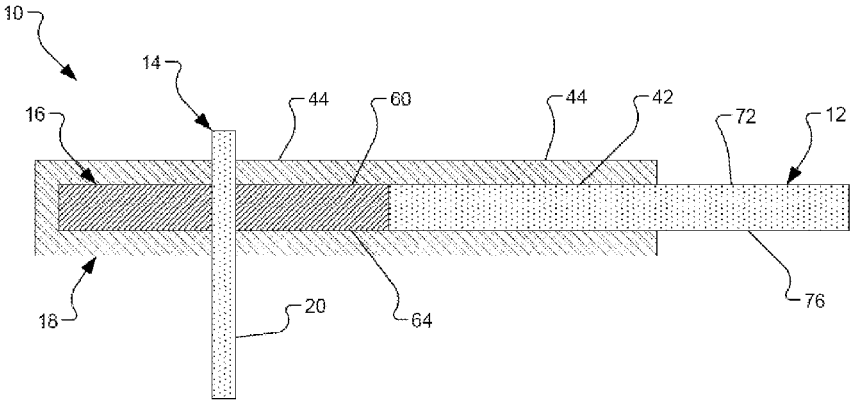
FIG. 5 is a cross-sectional view of another embodiment of the waterslide anchoring device according to the principles of the present disclosure.

It will be appreciated that the order of the method steps described above is not significant to completion of the method. Specifically, the stake element 14 may be assembled prior to adhering the first portion 62 of the upper side 42 of the adhesive element 18 against the first side 60 of the tab element 16, so that the stake element 14 is positioned substantially adjacent to the upper side 42 of the adhesive element 18 (FIG. 4). Alternatively, the stake element 14 may be assembled after adhering the adhesive element 18 to the tab element 16 and the waterslide 12, so that the stake element 14 is positioned substantially adjacent to the underside 44 of the adhesive element 18 (FIG. 5).

Figure 6:
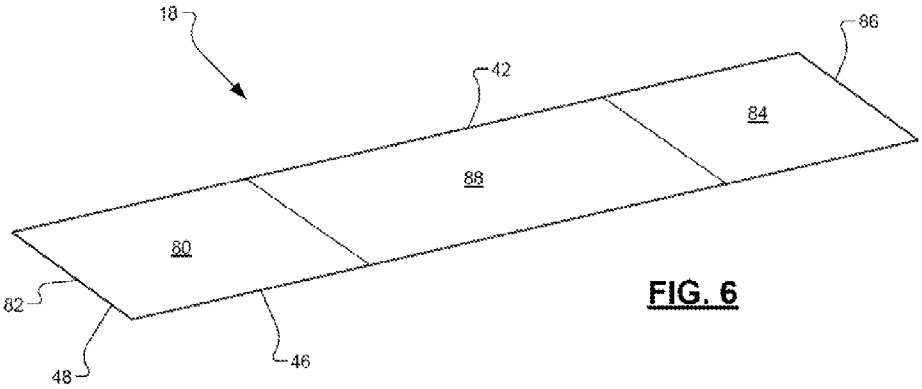
FIG. 6 is a perspective view of another embodiment of an adhesive element of the waterslide anchoring device according to the principles of the present disclosure.

In another embodiment shown in FIG. 6, the adhesive element 18 may include a first adhesive portion 80 proximate a first end 82 of the upper side 42 and a second adhesive portion 84 proximate a second end 86 of the upper side 42. The adhesive element 18 may further include a non-adhesive mid-portion 88 on the upper side 42. The mid-portion 88 may be located between the first and second adhesive portions 80, 84. The first and second adhesive portions 80, 84 may be adhered to the upper and lower surfaces 72, 76 of the waterslide 12, respectively, while the non-adhesive mid-portion 88 may be located proximate the tab element 16.

Figure 7:
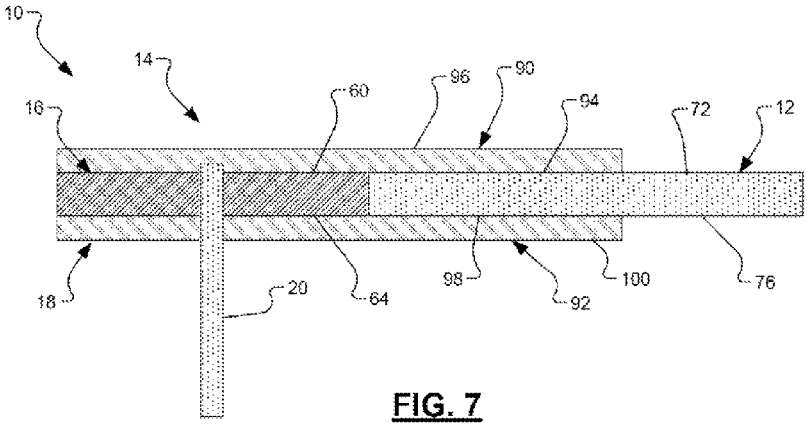
FIG. 7 is a cross-sectional view of another embodiment of the waterslide anchoring device according to the principles of the present disclosure.

In another embodiment shown in FIG. 7, the waterslide anchoring device 10 may include a first adhesive element 90 and a second adhesive element 92. The dimensions of the first adhesive element 90 may be substantially equal to the dimensions of the second adhesive element 92. The first adhesive element 90 may include a first adhesive side 94 and a first non-adhesive side 96. The second adhesive element 92 may include a second adhesive side 98 and a second non-adhesive side 100. The first adhesive side 94 may be located adjacent to the upper surface 72 of the waterslide 12 and the first side 60 of the tab element 16. The second adhesive side 98 may be located adjacent to the lower surface 76 of the waterslide 12 and the second side 64 of the tab element 16.

Figure 8:
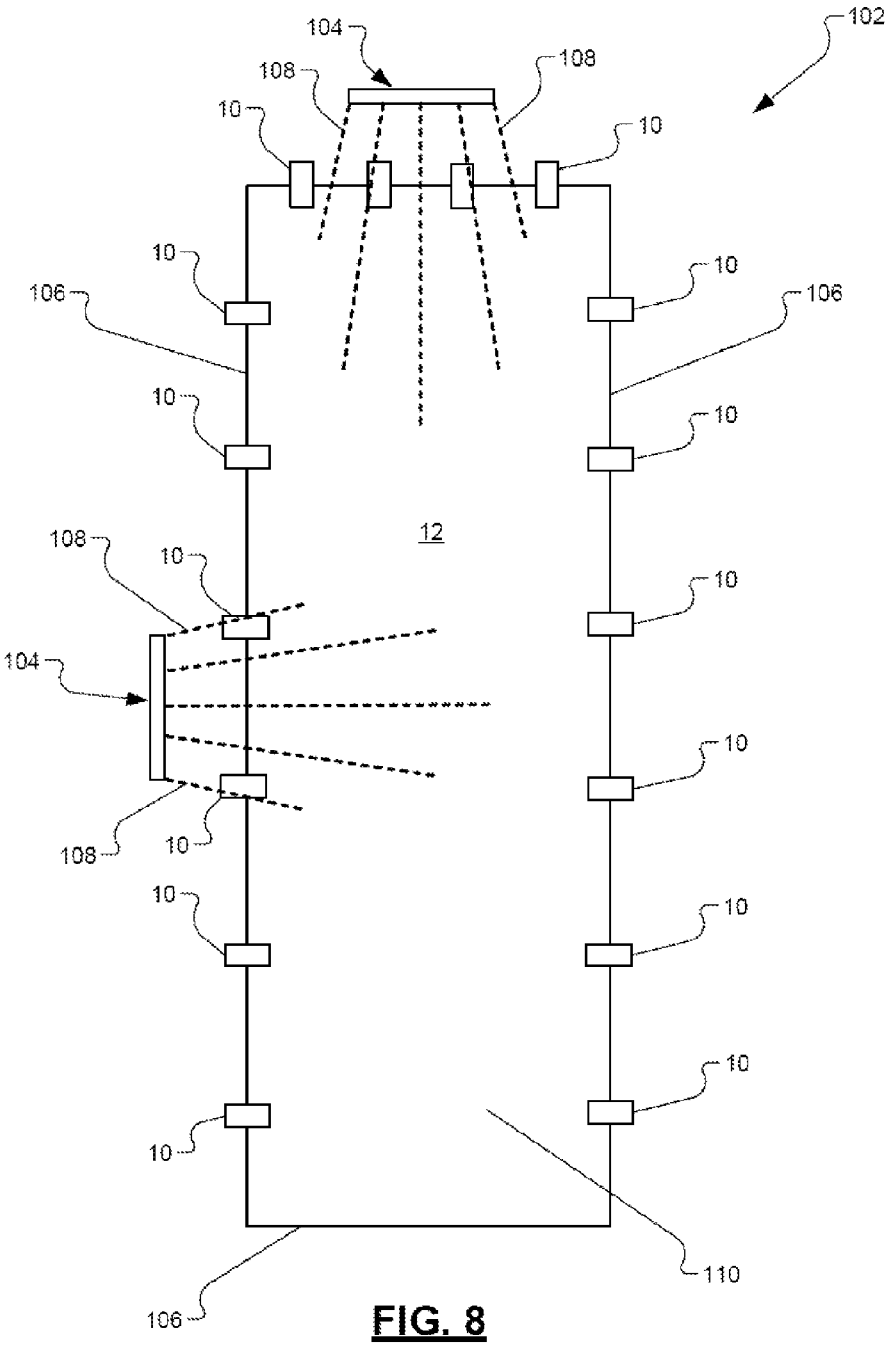
FIG. 8 is an overhead view of a waterslide and a plurality of waterslide anchoring devices according to the principles of the present disclosure.

With reference to FIG. 8, a waterslide assembly 102 is shown. The waterslide assembly 102 may include the waterslide 12, multiple waterslide anchoring devices 10, and an irrigation system 104. The waterslide anchoring devices 10 may be attached to a plurality of edges 106 of the waterslide 12 at a plurality of locations. In the particular embodiment illustrated in FIG. 8, the waterslide anchoring devices 10 are disposed at evenly spaced intervals along the edges 106.

The irrigation system 104 may include one or more sprinkler devices for providing a stream of water 108 on a surface 110 of the waterslide 12 to ensure a slippery surface that facilitates sliding. The sprinkler device of irrigation system 104 may be a fan sprinkler, an oscillating sprinkler, or any other sprinkler. Additionally or alternatively, the irrigation system 104 may include other irrigation means or techniques operable to deliver water to the surface 110 of the waterslide 12.

In an embodiment shown in FIGS. 9 and 10, the irrigation system 104 may include an archway water sprinkler 112 including a plurality of rods 114. The plurality of rods 114 may be located in a cross-wise fashion, meeting at a predetermined distance at a center point 116 above the waterslide 12. The plurality of rods 114 may include a plurality of fasteners 118 for attaching one or more drip hoses 120. In this way, a user may slide under the archway water sprinkler 112 with the stream of water 108 dripping from the drip hose 120 above. The plurality of rods 114 may be formed from a fiberglass or a plastic material, for example.

In an embodiment shown in FIG. 11, the irrigation system 104 may include the archway water sprinkler 112 and/or a water curtain 122. The water curtain 122 may be in communication with a water source and may include a plurality of holes (not shown) through which water may drip or flow onto the waterslide 12. Similar to the plurality of rods 114, the water curtain 122 may be located at the predetermined distance above the waterslide 12, so that the user may slide underneath the stream of water 108 dripping from above.

One or more obstacles 124 may be placed at an end 126 of the waterslide 12 for added user enjoyment. For example, the obstacle 124 may be made of a soft, cushioned or flexible material, or may be an inflatable structure. The one or more obstacles 124 may include a set of bowling pin-shaped objects, a wall, and/or a small pool, for example. In other embodiments, the one or more obstacles 124 may be shaped in the form of an animal, a sports or entertainment character, and/or any other animate or inanimate object.

Figure 12:
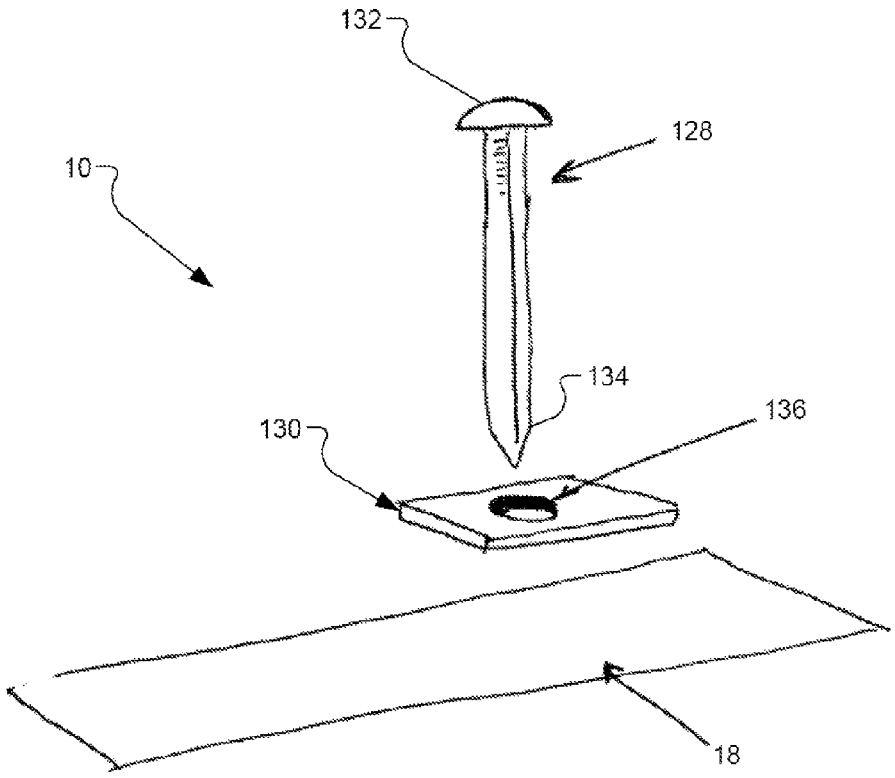
FIG. 12 is a perspective view of another embodiment of the waterslide anchoring device according to the principles of the present disclosure.

In another embodiment shown in FIG. 12, the waterslide anchoring device 10 may include a single-pronged stake element 128, a tab element 130, and the adhesive element 18. The single-pronged stake element 128 may include a rounded head 132 and a pointed tip 134. The tab element 130 may include at least one aperture 136 therethrough. The at least one aperture 136 may have a circular cross-section operable to receive the pointed tip 134 of the single-pronged stake element 128 in a similar fashion to the embodiments described above. The apertures 136 may include a counterbore or countersink portion (not shown) that may receive the rounded head 132 below an upper surface of the tab element 130.

Figure 13:
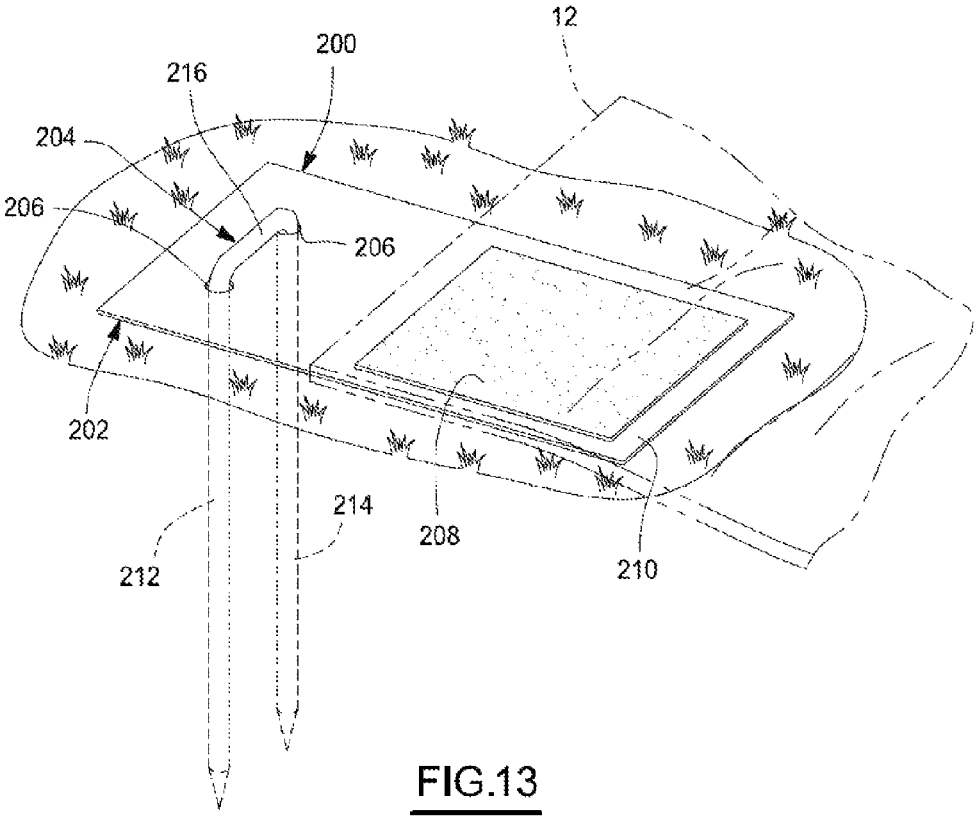
FIG. 13 is a perspective view of another embodiment of the waterslide anchoring device according to the principles of the present disclosure.

Referring now to FIG. 13, an anchoring device 200 is provided and may be used to secure the waterslide 12 relative to the ground. The anchoring device 200 may include a tab element 202 and a stake element 204. The tab element 202 may be formed from a polymeric material and may include a thickness of about thirty thousandths (0.030) of an inch, a length of about four to six inches, and a width of about two to four inches, for example. It will be appreciated that the tab element 202 may be formed having different dimensions than those described above. The tab element 202 may include one or more apertures 206 extending therethrough and an adhesive element 208 bonded to an upper surface 210. The adhesive element 208 may include a pressure-sensitive adhesive. Prior to assembly onto the waterslide 12, an easily removable paper or plastic protective layer (not shown) may be disposed on the adhesive element 208 to preserve the adhesive strength of the adhesive element 208.

The stake element 204 may be a generally U-shaped member having first and second legs 212, 214 and a central portion 216 connecting the first and second legs 212, 214. The first and second legs 212, 214 may be inserted through the apertures 206 in the tab element 202. The stake element 204 may have a length of about six inches, for example, or any other suitable length.

In operation, the tab element 202 may be disposed on a ground surface such that the adhesive element 208 on the upper surface 210 is facing a direction opposite the ground. The first and second legs 212, 214 of the stake element 204 may be inserted through corresponding apertures 206 and into the ground to fix the tab element 202 relative to the ground. A portion of the waterslide 12 may be placed in contact with the adhesive element 208. A user may apply pressure to the tab element 202 and the waterslide 12 to activate the pressure-sensitive adhesive of the adhesive element 208 and enhance the adhesive bond between the waterslide 12 and the tab element 202. While the particular pressure-sensitive adhesive employed may be chosen to provide a sufficiently strong bond between the tab element 202 and the waterslide 12 such that the waterslide 12 does not easily disengage from the tab element 202 during normal use of the waterslide 12, the bond strength of the adhesive element 208 may allow the waterslide 12 to disengage from the tab element 202 in response to a force applied to the waterslide 12 relative to the tab element 202 that is sufficient to plastically deform the waterslide 12. In other words, the sheer strength of the adhesive bond may selected to be less than the tensile yield strength of the waterslide 12. In this manner, the waterslide 12 may break free from the anchoring device 200 before an external force rips or permanently stretches the material of the waterslide 12.

Figure 14:
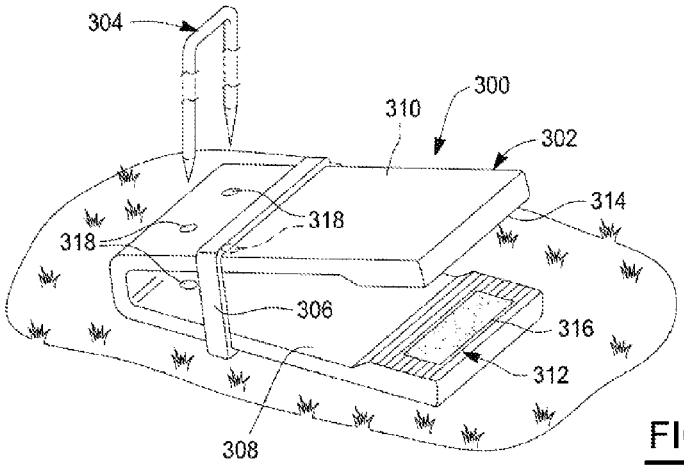
FIG. 14 is a partially exploded perspective view of yet another embodiment of the waterslide anchoring device in an open position according to the principles of the present disclosure.
Figure 15:
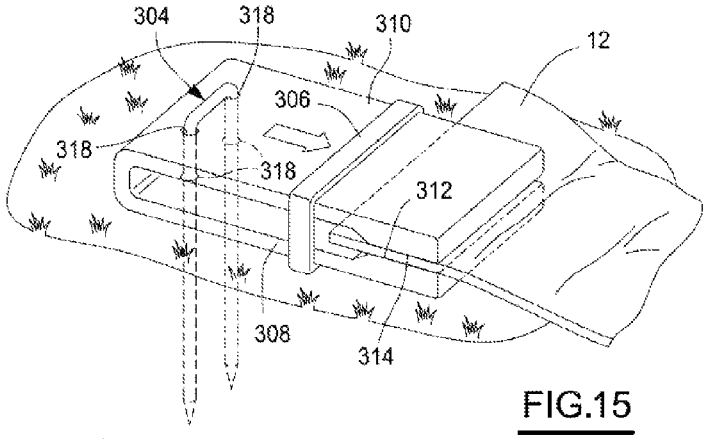
FIG. 15 is perspective view of the anchoring device of FIG. 14 in a closed position.

Referring now to FIGS. 14 and 15, an anchoring device 300 is provided and may include a tab element 302, a stake element 304, and a band or collar 306. The tab element 302 may include first and second arms 308, 310 that may be integrally formed with each other and may cooperate to form a substantially U-shaped or V-shaped clamp. The tab element 302 may be formed from relatively thin polymeric or metallic material, and may have an overall thickness of less than one half of an inch, or preferably, less than one quarter of an inch. In this manner, the anchoring device 300 may have a relatively low profile to minimize or negate inadvertent contact with a person sliding across the waterslide 12.

The first and second arms 308, 310 may be movable relative to each other between an open position (FIG. 14) and a closed position (FIG. 15). Distal ends 311 of the first and second arms 308, 310 may include first and second gripping portions 312, 314, respectively. Each of the first and second gripping portions 312, 314 may include a rubber strip or pressure-sensitive adhesive strip 316, for example, and/or other features to increase the coefficient of friction of the first and second gripping portions 312, 314. Apertures 318 may be disposed through the first and second arms 308, 310 and spaced apart from the first and second gripping portions 312, 314.

The band or collar 306 may be an elastomeric, textile, polymeric or metallic member, for example. The collar 306 may be disposed around the first and second arms 308, 310 between the apertures 318 and the first and second gripping portions 312, 314. The collar 306 may be slidable relative to the first and second arms 308, 310 between a first position (FIG. 14) and a second position (FIG. 15). An unstretched perimeter dimension of the collar 306 may be sized such that moving the collar 306 into the second position forces the first and second arms 308, 310 to move relative to each other into the closed position. Conversely, moving the collar 306 from the second position into the first position may allow the first and second arms 308, 310 to move back into the open position. The tab element 302 may be formed such that when the tab element 302 is unrestrained by the collar 306, the first and second arms 308, 310 resiliently spring back toward the open position.

As shown in FIG. 15, the collar 306 may be moved into the second position to retain the tab element 302 in the closed position such that a portion of the waterslide 12 may be clamped between the first and second gripping portions 312, 314. The stake element 304 may be inserted through the apertures 318 and into the ground to secure the tab element 302 relative to the ground.

The clamping force of the first and second arms 308, 310 may be sufficient to prevent the waterslide 12 from easily disengaging from the tab element 302 during normal use of the waterslide 12, while still allowing the waterslide 12 to disengage from the tab element 302 in response to a force applied to the waterslide 12 relative to the tab element 302 that is sufficient to plastically deform the waterslide 12. In other words, the clamping strength of the tab element 302 may selected to be less than the tensile yield strength of the waterslide 12. In this manner, the waterslide 12 may break free from the anchoring device 300 before an external force rips or permanently stretches the material of the waterslide 12.

Figure 16:
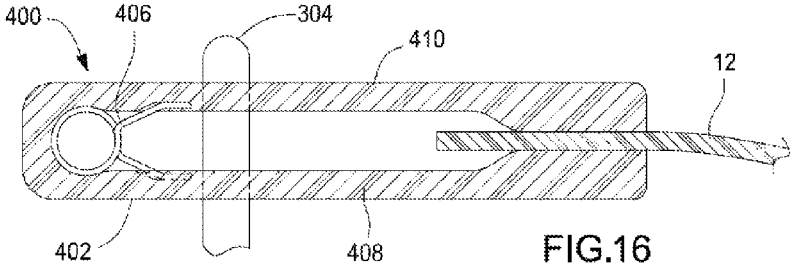
FIG. 16 is a partially exploded perspective view of still another embodiment of the waterslide anchoring device in an open position according to the principles of the present disclosure.

Referring now to FIG. 16, an anchoring device 400 is provided and may include a tab element 402 and the stake element 304 described above. The tab element 402 may include first and second arms 408, 410 and a spring member 406. The first and second arms 408, 410 may be substantially similar to the first and second arms 308, 310 described above, and therefore, will not be described again in detail. The spring member 406 may be a torsion spring or any other type of spring disposed between the first and second arms 408, 410 and operatively attached thereto to urge the first and second arms 408, 410 from the open position toward the closed position.

As described above with reference to the anchoring device 300, The clamping force of the first and second arms 308, 310 may be sufficient to prevent the waterslide 12 from easily disengaging from the tab element 302 during normal use of the waterslide 12, while still allowing the waterslide 12 to disengage from the tab element 302 in response to a force applied to the waterslide 12 relative to the tab element 302 that is sufficient to plastically deform the waterslide 12. In other words, the clamping strength of the tab element 302 may selected to be less than the tensile yield strength of the waterslide 12. In this manner, the waterslide 12 may break free from the anchoring device 300 before an external force rips or permanently stretches the material of the waterslide 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus comprising:

a flexible polymeric sheet having first and second sides;

an anchoring device including a tab element, a pressure-sensitive adhesive element, and a stake element, wherein said tab element includes at least one aperture to receive said stake element.

2. The apparatus of claim 1, wherein a height of said tab element is less than either a length of a first side of said tab element or a length of a second side of said tab element.

3. The apparatus of claim 2, wherein said tab element is semi-rigid poly material and having a thickness of thirty thousandths (0.030) of an inch.

4. The apparatus of claim 1, wherein said stake element includes multiple prongs and said tab element includes multiple apertures to receive said stake element.

5. The apparatus of claim 4, wherein each of said prongs has a length that is approximately equal to a distance between said tab apertures.

6. The apparatus of claim 1, wherein said adhesive element includes a bond strength allowing disengagement from said tab element in response to a force applied to said polymeric sheet relative to said tab element sufficient to plastically deform said polymeric sheet.

7. The apparatus of claim 6, wherein a sheer strength of said bond strength is less than a tensile yield strength of said polymeric sheet.

8. The apparatus of claim 1, wherein said tab element and said pressure-sensitive adhesive element are joined and affixed to first and second sides of said flexible polymeric sheet.

9. The apparatus of claim 1, wherein said tab element includes first and second arms cooperating to form a clamp.

10. The apparatus of claim 1, wherein said flexible polymeric sheet is formed from a material selected from a group consisting of polyethylene, polyvinylchloride, and polypropylene.

11. The apparatus of claim 1, wherein said flexible polymeric sheet is formed from a material having a thickness between five thousandths (0.005) and ten thousandths (0.010) of an inch.

12. The apparatus of claim 1, further comprising an irrigation device adapted to distribute water onto a surface of said flexible polymeric sheet.

13. The apparatus of claim 12, wherein said irrigation device include an archway water sprinkler.

14. The apparatus of claim 12, wherein said irrigation device provides a water curtain.

15. The apparatus of claim 1, further comprising a resiliently compliant obstacle adapted to be positioned on said flexible polymeric sheet.

16. An apparatus comprising:

a flexible polymeric sheet having first and second sides;

an anchoring device including a pressure-sensitive adhesive element, a stake element and a tab element, wherein said tab element is semi-rigid poly material and having a thickness of thirty thousandths (0.030) of an inch and a height of said tab element is less than either a length of a first side of said tab element or a length of a second side of said tab element.

17. The apparatus of claim 16, wherein said tab element includes at least one aperture to receive said stake element.

18. The apparatus of claim 16, wherein said tab element and said pressure-sensitive adhesive element are joined and affixed to first and second sides of said flexible polymeric sheet.

19. The apparatus of claim 16, wherein said flexible polymeric sheet is formed from a material selected from a group consisting of polyethylene, polyvinylchloride, and polypropylene.

20. The apparatus of claim 16, wherein said flexible polymeric sheet is formed from a material having a thickness between five thousandths (0.005) and ten thousandths (0.010) of an inch.

21. The apparatus of claim 16, further comprising an irrigation device adapted to distribute water onto a surface of said flexible polymeric sheet.

22. The apparatus of claim 21, wherein said irrigation device include an archway water sprinkler.

23. The apparatus of claim 21, wherein said irrigation device provides a water curtain.

24. The apparatus of claim 16, further comprising a resiliently compliant obstacle adapted to be positioned on said flexible polymeric sheet.

25. An apparatus comprising:

a flexible polymeric sheet having first and second sides;

an anchoring device including a pressure-sensitive adhesive element, a stake element including multiple prongs and a tab element including multiple apertures to receive said stake element.

26. The apparatus of claim 25, wherein each of said prongs has a length that is approximately equal to a distance between said tab apertures.

27. The apparatus of claim 25, wherein said tab element includes at least one aperture to receive said stake element.

28. The apparatus of claim 25, wherein said tab element and said pressure-sensitive adhesive element are joined and affixed to first and second sides of said flexible polymeric sheet.

29. The apparatus of claim 25, wherein said flexible polymeric sheet is formed from a material selected from a group consisting of polyethylene, polyvinylchloride, and polypropylene.

30. The apparatus of claim 25, wherein said flexible polymeric sheet is formed from a material having a thickness between five thousandths (0.005) and ten thousandths (0.010) of an inch.

31. The apparatus of claim 25, further comprising an irrigation device adapted to distribute water onto a surface of said flexible polymeric sheet.

32. The apparatus of claim 31, wherein said irrigation device include an archway water sprinkler.

33. The apparatus of claim 31, wherein said irrigation device provides a water curtain.

34. The apparatus of claim 25, further comprising a resiliently compliant obstacle adapted to be positioned on said flexible polymeric sheet.

35. An apparatus comprising:

a flexible polymeric sheet having first and second sides;

an anchoring device including a stake element, a tab element, and a pressure-sensitive adhesive element including a bond strength allowing disengagement from said tab element in response to a force applied to said polymeric sheet relative to said tab element sufficient to plastically deform said polymeric sheet.

36. The apparatus of claim 35, wherein a sheer strength of said bond strength is less than a tensile yield strength of said polymeric sheet.

37. The apparatus of claim 35, wherein said tab element includes at least one aperture to receive said stake element.

38. The apparatus of claim 35, wherein said tab element and said pressure-sensitive adhesive element are joined and affixed to first and second sides of said flexible polymeric sheet.

39. The apparatus of claim 35, wherein said flexible polymeric sheet is formed from a material selected from a group consisting of polyethylene, polyvinylchloride, and polypropylene.

40. The apparatus of claim 35, wherein said flexible polymeric sheet is formed from a material having a thickness between five thousandths (0.005) and ten thousandths (0.010) of an inch.

41. The apparatus of claim 35, further comprising an irrigation device adapted to distribute water onto a surface of said flexible polymeric sheet.

42. The apparatus of claim 41, wherein said irrigation device include an archway water sprinkler.

43. The apparatus of claim 41, wherein said irrigation device provides a water curtain.

44. The apparatus of claim 35, further comprising a resiliently compliant obstacle adapted to be positioned on said flexible polymeric sheet.

45. An apparatus comprising:

a flexible polymeric sheet having first and second sides;

an anchoring device including a pressure-sensitive adhesive element, a stake element, and a tab element including first and second arms cooperating to form a clamp.

46. The apparatus of claim 45, wherein said tab element includes at least one aperture to receive said stake element.

47. The apparatus of claim 45, wherein said tab element and said pressure-sensitive adhesive element are joined and affixed to first and second sides of said flexible polymeric sheet.

48. The apparatus of claim 45, wherein said flexible polymeric sheet is formed from a material selected from a group consisting of polyethylene, polyvinylchloride, and polypropylene.

49. The apparatus of claim 45, wherein said flexible polymeric sheet is formed from a material having a thickness between five thousandths (0.005) and ten thousandths (0.010) of an inch.

50. The apparatus of claim 45, further comprising an irrigation device adapted to distribute water onto a surface of said flexible polymeric sheet.

51. The apparatus of claim 50, wherein said irrigation device include an archway water sprinkler.

52. The apparatus of claim 50, wherein said irrigation device provides a water curtain.

53. The apparatus of claim 45, further comprising a resiliently compliant obstacle adapted to be positioned on said flexible polymeric sheet.

* * * * *